US006793164B2

(12) United States Patent
Stroppiana

(10) Patent No.: US 6,793,164 B2
(45) Date of Patent: Sep. 21, 2004

(54) PROCESS FOR REMOVING SYNTHETIC-GRASS FLOORINGS, CORRESPONDING USE AND PRODUCT

(75) Inventor: Fernando Stroppiana, Grinzane Cavour (IT)

(73) Assignee: Mondo S.p.A. (IT)

( * ) Notice: Subject to any disclaimer, the term of this patent is extended or adjusted under 35 U.S.C. 154(b) by 0 days.

(21) Appl. No.: 10/286,599

(22) Filed: Oct. 31, 2002

(65) Prior Publication Data

US 2003/0106949 A1 Jun. 12, 2003

(30) Foreign Application Priority Data

Dec. 11, 2001 (IT) ..... TO2001A1154

(51) Int. Cl.[7] ..... B02C 17/00
(52) U.S. Cl. ..... 241/24.18
(58) Field of Search ..... 241/24.18, 160, 241/242; 428/17, 87

(56) References Cited

U.S. PATENT DOCUMENTS

| | | | | |
|---|---|---|---|---|
| 3,731,923 A | | 5/1973 | Greene | |
| 4,146,662 A | | 3/1979 | Eggers et al. | |
| 4,337,283 A | | 6/1982 | Haas, Jr. | |
| 4,337,628 A | | 7/1982 | Greene | |
| 5,494,628 A | | 2/1996 | Beyer et al. | |
| 5,855,981 A | * | 1/1999 | Zegler et al. | 428/95 |
| 5,897,066 A | * | 4/1999 | Bacon et al. | 241/160 |
| 5,902,414 A | * | 5/1999 | Keal et al. | 134/37 |
| 5,958,527 A | | 9/1999 | Prevost | |
| 5,976,645 A | | 11/1999 | Daluise et al. | |
| 6,007,659 A | | 12/1999 | Hasegawa | |
| 6,242,062 B1 | | 6/2001 | de Vries | |
| 6,338,885 B1 | | 1/2002 | Prevost | |

FOREIGN PATENT DOCUMENTS

| | | | | |
|---|---|---|---|---|
| DE | 4136444 | * | 5/1993 | 241/24.18 |
| DE | 195 42 497 A | | 4/1997 | |
| EP | 0 185 646 A | | 6/1986 | |
| EP | 0 185 656 B1 | | 5/1989 | |
| EP | 1 158 099 A2 | | 11/2001 | |
| GB | 1 446 036 A | | 8/1976 | |
| GB | 2 142 355 A | | 1/1985 | |

* cited by examiner

*Primary Examiner*—Ed Tolan
(74) *Attorney, Agent, or Firm*—TraskBritt

(57) ABSTRACT

The process applies to synthetic-grass floorings of the type comprising a sheet substrate with a plurality of filiform formations extending from the substrate to simulate natural-grass cover or turf, the substrate and the filiform formations being made of plastic material, as well as a particulate filling material or infill dispersed between the filiform formations so as to maintain the filiform formations in a substantially erect condition. The process comprises the operations of removing the synthetic-grass flooring from the laid condition and subjecting the sheet substrate and the filiform formations to shredding so as to produce a salvaged particulate material. This salvaged particulate material can then be used as component of the particulate filling material or infill in a synthetic-grass flooring that is to be newly laid.

9 Claims, 2 Drawing Sheets

PROCESS FOR REMOVING SYNTHETIC-GRASS FLOORINGS, CORRESPONDING USE AND PRODUCT

Figure 1:
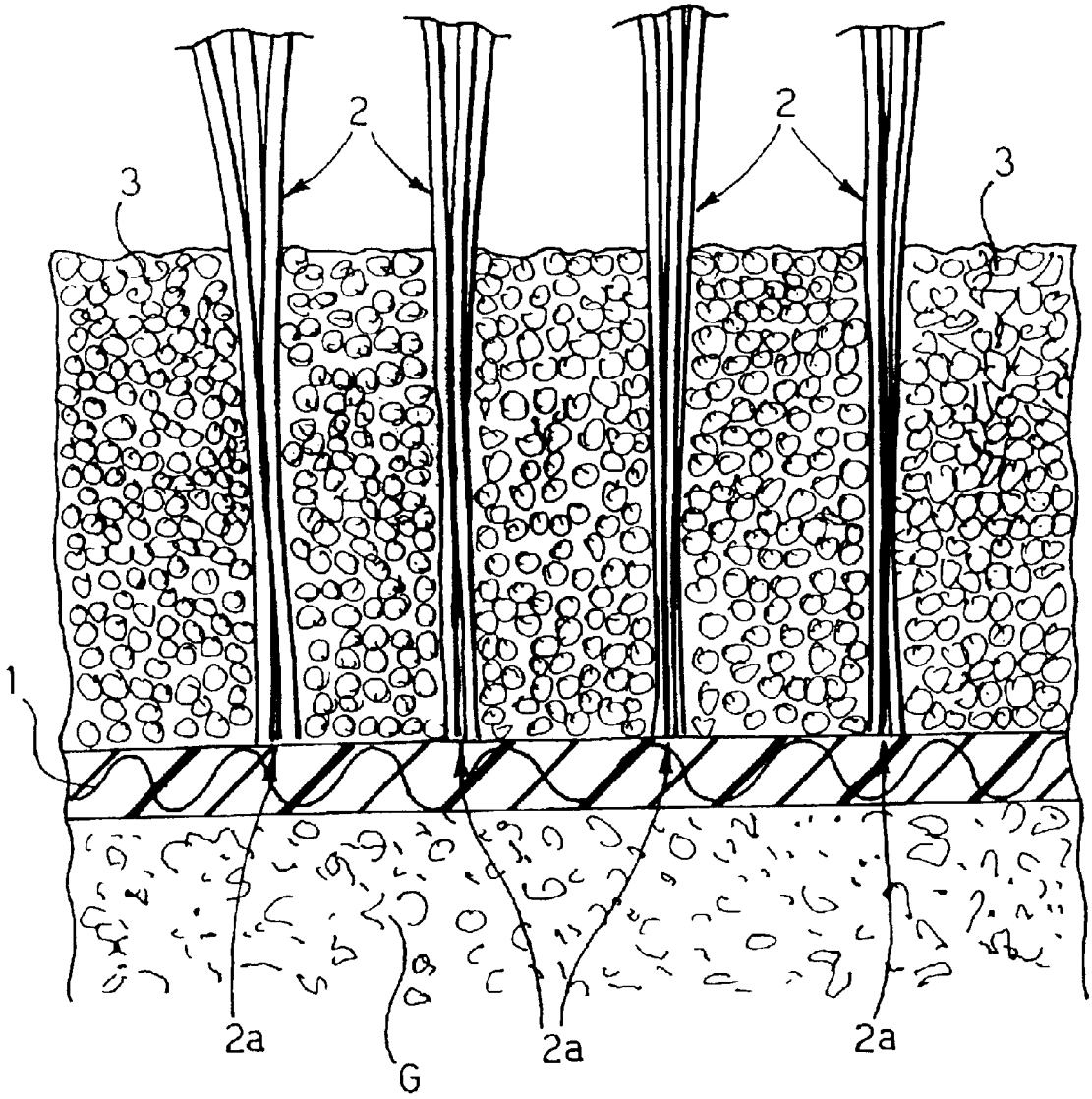

The present invention relates to synthetic-grass structures and regards more specifically the removal of synthetic-grass structures.

A synthetic-grass structure of the above type is known, for example, from EP-A-1 158 099.

Basically, a synthetic-grass structure of the type referred to above comprises, in normal laying conditions, a sheet substrate with a plurality of filiform formations that extend upwards starting from the substrate itself so as to simulate natural-grass cover or natural turf. A particulate filling material or infill is dispersed between the filiform formations so as to maintain them in a substantially erect condition.

The solution described in the document cited above specifically envisages that the aforesaid filling material or infill should consist of a substantially homogeneous mass of a granular material chosen in the group made up of polyolefin-based materials and vinyl-polymer-based materials.

In other solutions, such as the one described in U.S. Pat. No. 5,958,527, instead, the infill comprises a plurality of layers of granular material, such as sand, fragmented rubber material, obtained for example as material recycled from used tyres, and/or mixtures of the two.

The synthetic-grass structures are increasingly considered as being a valid alternative to natural-grass cover. This, in particular, regards applications (sports facilities, etc.) in which, for different reasons (environmental conditions, intense use, etc.), upkeep of natural turf proves to be a critical problem, also on account of the maintenance costs involved.

Prolonged exposure to environmental agents (light, atmospheric agents of various nature, etc.) renders it, however, necessary to replace the synthetic-grass cover at intervals in the region of, for example, 4–12 years.

The operation of replacement involves pulling up the synthetic-grass flooring that was previously laid and the consequent gathering-up and disposal of the corresponding components.

This applies chiefly as regards the sheet substrate and the filiform formations which simulate natural grass. In many cases, the same considerations apply, however, also to the filling materials, above all in the case where the infill was initially distributed in a number of superimposed layers of different materials, which are inevitably bound to mix together during use and even more during the operation of removal of the flooring.

The purpose of the present invention is to enable the removal of synthetic-grass floorings to be carried out in conditions that make possible a high degree of re-use of the materials that make up the synthetic-grass flooring that is pulled up in order to be able to lay a new synthetic-grass flooring. The possibility of salvaging and re-using the material is significant both in economic terms and in environmental terms if it is taken into account that synthetic-grass floorings are currently widely used for sports facilities, such as soccer fields, rugby fields or American-football fields, in which the surface of the synthetic-grass floorings may measure even several thousand square meters in area.

In accordance with the present invention, the above purpose is achieved thanks to a process having the characteristics recalled specifically in the ensuing claims. The invention also regards the corresponding use and the corresponding product of the salvaging operation.

Essentially, the solution according to the invention is based upon the recognition of the fact—an altogether unexpected and surprising one—that the particulate material obtained from shredding of the sheet substrate and filiform formations of a synthetic-grass flooring that needs to be pulled up can be used to advantage—either completely or in part—as particulate infill made of plastic material according to the criteria set down in EP-A-1 158 099 already cited previously. This is true even if the synthetic-grass flooring that is pulled up has been exposed to environmental and atmospheric agents for a prolonged period of time, i.e., in the region of the time intervals involved in the change of synthetic-grass floorings referred to previously.

Figure 2:
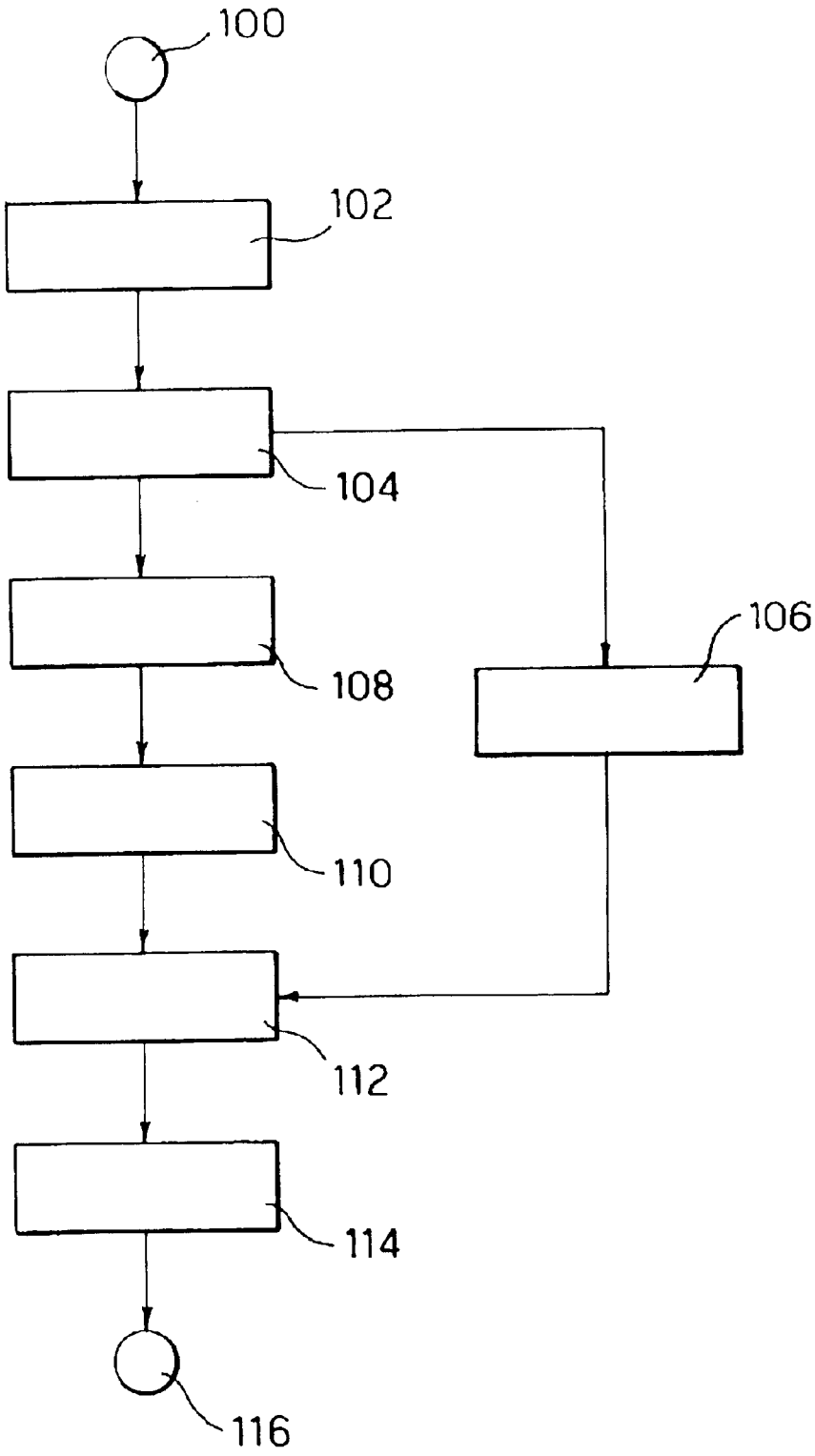

The present invention will now be described, purely by way of non-limiting example, with reference to the attached drawings, in which:

FIG. 1 reproduces schematically an idealized vertical section of a synthetic-grass structure according to the invention; and FIG. 2 illustrates, in the form of a flowchart, the various operating steps involved in the currently preferred embodiment of the process according to the invention.

The structure of the synthetic-grass flooring illustrated in FIG. 1 comprises a sheet substrate 1 designed to be laid on a subfloor G, which, in the most typical condition of use, consists of a subfloor made of tamped earth or of a bituminous mat, over which the synthetic-grass cover is laid usually in free-laying conditions.

The sheet substrate 1 may be made up of a sheet of plastic material, such as a non-woven fabric (possibly consisting of a number of layers) that has a base of polyolefins, such as polypropylene, with associated thereto, so as to provide a suitable matrix of retention and stabilization, a mass of plastic material, such as SBR rubber latex.

Starting from the substrate 1, a plurality of filiform formations 2 extend upwards, the said filiform formations being usually arranged in tufts so as to resemble more closely the blades of grass of natural-grass cover.

The filiform formations 2 are anchored to the substrate 1 at their proximal ends, designated by 2*a*, and extend upwards with their distal ends for a total length—measured starting from the general plane of extension of the substrate 1—which may typically be in the 30-mm to 60-mm range, according to the applications envisaged.

The general criteria for making the substrate 1 and the filiform formations 2 (including the modalities for obtaining firm anchorage of the proximal ends 2*a* of the filiform formations 2 to the substrate 1) are known to the art, and hence do not require a detailed description herein, also because they are of themselves not important for the purposes of understanding the present invention.

For instance, it is known that the filiform formations 2 are generally made of a plastic material, such as a polyolefin (polyethylene, polypropylene, and/or the corresponding copolymers).

Likewise known is the fact that on the surface of the substrate 1 facing the subfloor G there may be present a layer of foamed material, such as rubber latex (not shown in the drawing).

Also known is the fact that usually, during laying of the synthetic-grass flooring, above the substrate 1 and hence between the filiform formations 2, there is dispersed a particulate filling material (infill). The function of this material is to keep the filiform formations 2 in the upright condition, i.e., preventing them from lying down flat on the substrate 1 in an undesirable way.

The particulate filling material 3 is dispersed between the filiform formations 2 in a sufficient amount to cause the distal portions of the filiform formations 2 to be supported by the infill 3 for a length of between, for example, 20 and 30 mm. This means that the distal ends of the filiform formations 2 project from the top surface of the layer of infill 3 for a length in the region of 10–20 mm.

In the synthetic-grass flooring structure described in U.S. Pat. No. 5,958,527, the aforesaid infill comprises:

- a bottom or foundation layer, consisting practically exclusively of granular material 2 such as, typically, sand;
- a top layer consisting practically exclusively of granules of compliant material consisting, for example, of fragmented rubber material, preferably obtained as recycled material from used tyres; and
- an intermediate layer comprising a mixture of the two particulate materials referred to above in selectively pre-determined weight ratios.

In the solution described in EP-A-1 158 099, the particulate material 3 is, instead, a homogeneous material dispersed on top of the substrate 1 between the filiform formations 2 in a substantially uniform way, without giving rise to superimposed layers having differentiated characteristics. Preferably, the aforesaid particulate material is a granular material having a grain size typically of between 0.5 and 4.5 mm and a density typically of between 1.5 and 1.6 g/cm$^3$.

The said material may consist of a polyolefin material, such as polyethylene, and, even more preferably, of a recycled olefin material, such as recycled polyethylene.

Alternatively, the material consists of a vinylic polymer such as PVC, and, even more preferably, of a recycled vinylic polymer, such as recycled PVC. The said infill is, also on account of its altogether uniform structure, completely re-usable and recyclable in the case of removal of the synthetic-grass flooring.

The same, instead, does not apply, other than to a partial extent and at the expense of somewhat burdensome operations of treatment, in the case where the infill is made up to a greater or lesser extent of sand.

Basically, the solution according to the invention extends the possibility of recycling/salvage of the material (or rather to the complex of materials) that make up the sheet substrate and the filiform formations of the synthetic-grass flooring, with the added possibility of obtaining from said material—given its nature of plastic material—particulate material that can be used as infill for a synthetic-grass flooring structure that is to be newly laid.

It will therefore be appreciated that the solution according to the invention can also be applied to synthetic-grass structures originally comprising a particulate infill other than a plastic material, for instance, sand.

In the case of a synthetic-grass flooring structure that already comprises a particulate infill consisting of plastic material such as polyolefin-based material and/or vinyl-polymer-based material, the solution according to the invention offers a practically complete possibility of recovery and recycling of said material.

In the flowchart of FIG. 2, starting from an initial start-up step, designated by 100, the reference number 102 designates the operation of removal of the synthetic-grass flooring structure that is to be pulled up from the laid condition.

The said operation is carried out preferably with the aid of mechanical means such as, for example, motor-driven machines for gathering and cutting into strips the synthetic-grass flooring that is pulled up, with a view to the possible collection of the material in the form, for instance, of ribbons or reels.

The reference number 104 designates a step in which the sheet substrate 1 and the filiform formations 2 are separated from the infill 3. This operation can be carried out, for example, by subjecting said synthetic-grass flooring removed from the laid condition to an operation of shaking (for instance using a vibrator device). The shaking operation may involve turning the synthetic-grass structure upside down so as to cause the filiform formations simulating natural-grass cover to face downwards to facilitate dropping of the particulate infill made of plastic material.

The operation represented by block 104 is practically compulsory in the case where the synthetic-grass flooring that is pulled up is provided with a sand-based particulate material. It is, instead, optional in the case where the synthetic-grass flooring that is pulled up comprises a particulate filling material which is itself made of plastic material.

Also in this latter case, the operation of sorting (step 104) represents in any case a preferential choice given that the polyolefin-based and/or vinyl-polymer-based particulate material in question may be directly sent on for recycling (in the terms described in greater detail in what follows) after possibly undergoing a reconditioning operation, represented schematically by block 106 and aimed, for instance, at purifying the aforesaid particulate filling material from dust and/or dirt of various nature that has collected during the previous period of use.

Returning to the main line of the flowchart of FIG. 2, the step designated by 108 envisages that the plastic material forming the sheet substrate 1 and the filiform formations 2 (as well as possibly the particulate material of a similar nature that may have remained in the case where the separation step 104 has not been carried out) will be chopped up, for example undergoing an operation of shredding. This operation is performed, preferably by means of a cold process (i.e., without any supply of thermal energy from outside), using mechanical shredding apparatus currently available, of the type used, for example, for breaking up recycled material obtained from used tyres.

The reference number 110 designates an (optional) operation of sifting, to which the material resulting from the shredding process 108 is subjected so as to ensure that the said material will have a selectively predetermined grain size, for instance between 0.5 and 4.5 mm.

The reference number 112 designates an operation of mixing, in which the material resulting from the shredding process 108 and sifting process 110 (if carried out) is mixed with the particulate material previously separated in step 104 (if it has been required to undergo reconditioning in step 106) and/or with similar "fresh" material.

Of course, in the case where the operation of sorting or separation represented by block 104 has not been carried out previously, it is possible to do without the mixing operation represented by step 112.

Block 114 (which precedes a final block 116) represents the operation of re-use proper of the particulate material obtained in the previous steps.

The above operation of re-use basically corresponds to the new use of the particulate material in question as particulate infill in a synthetic-grass flooring structure that is to be newly laid according to the criteria set down in EP-A-1 158 099.

The said operation, which envisages dispersing at least part of the salvaged particulate material 3 in a synthetic-grass flooring structure to be newly laid, can be carried out directly in situ, i.e., where removal of a pre-existing synthetic-grass flooring structure that is carried out (after prior location in situ of a new sheet substrate that is to constitute the sheet substrate of the synthetic-grass flooring that is to be newly laid) at a distance—whether in space or in time—with respect to the operation of removal of the pre-existing synthetic-grass flooring.

In the latter case, the salvaged particulate material obtained by shredding in the step designated by 108 (possibly subjected to sifting in step 110 and mixing of other granular material in step 112) constitutes an intermediate product of recycling that can be used independently.

Of course, without prejudice to the principle of the invention, the details of construction and the embodiments may vary widely with respect to what is described and illustrated herein, without thereby departing from the scope of the present invention.

What is claimed is:

1. A process for removing synthetic-grass floorings of the type comprising:

a sheet substrate with a plurality of filiform formations that extend from the substrate to simulate natural-grass cover or sward, said substrate and said filiform formations consisting of plastic material; and a particulate filling material or infill dispersed between said filiform formations so as to maintain said filiform formations in a substantially erect condition; the process comprising the operations of:

removing the synthetic-grass flooring from the laid condition; and subjecting said sheet substrate and said filiform formations to shredding so as to produce a salvaged particulate material, utilizing said salvaged particulate material as a second particulate filling material or infill in a second synthetic-grass flooring to be newly laid.

2. The process according to claim 1, further comprising the operation of separating said particulate filling material or infill from said sheet substrate and said filiform formations prior to subjecting said sheet substrate and said filiform formations to shredding.

3. The process according to claim 2, further comprising the operation of mixing said salvaged particulate material with said particulate filling material or infill separated from said sheet substrate and said filiform formations.

4. The process according to claim 1, in which said particulate filling material or infill consists of a substantially homogeneous mass of a granular plastic material, said process further comprising the operation of separating said particulate filling material or infill from said sheet substrate and said filiform formations prior to subjecting said sheet substrate and said filiform formations to shredding and thereafter mixing said salvaged particulate material with said particulate filling material or infill separated from said sheet substrate and said filiform formations of the synthetic-grass flooring undergoing removal.

5. The process according to claim 4, wherein said particulate filling material or infill, separated from said sheet substrate and said filiform formations, is subjected to an operation of reconditioning before being mixed with said salvaged particulate material.

6. The process according to claim 1 for the removal of a synthetic-grass flooring, in which said particulate filling material or infill consists of a substantially homogeneous mass of a granular plastic material, said process further comprising the operation of subjecting to shredding both said sheet substrate and said filiform formations, as well as said particulate filling material or infill.

7. The process according to claim 1, wherein said salvaged particulate material has a grain size of between 0.5 and 4.5 mm.

8. The process according claim 1, wherein said salvaged particulate material is produced by means of an operation of shredding which is carried out without supplying heat from outside.

9. The process according to claim 1, further comprising the operation of sifting said salvaged particulate material undergoes sifting.

* * * * *